US006584207B1

(12) United States Patent
Yoest et al.

(10) Patent No.: US 6,584,207 B1
(45) **Date of Patent: *Jun. 24, 2003**

(54) MOLDED HEARING AID HOUSING

(75) Inventors: Robert S. Yoest, Northbrook, IL (US); Paul R. Stonikas, Darien, IL (US); Roman Klyachman, DesPlaines, IL (US); Gregory Prutnikov, Niles, IL (US); Ankur M. Chhadia, Schaumburg, IL (US)

(73) Assignee: Beltone Electronics Corporation, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/356,288

(22) Filed: Jul. 16, 1999

Related U.S. Application Data

(60) Provisional application No. 60/118,261, filed on Feb. 2, 1999, and provisional application No. 60/122,770, filed on Mar. 3, 1999.

(51) Int. Cl.[7] ..... H04R 25/00

(52) U.S. Cl. ..... 381/322; 381/328

(58) Field of Search ..... 381/312, 322, 381/326, 328; 600/25; 607/55–57; 181/129–130, 135, 132–137; 264/219–222; 423/388

(56) References Cited

U.S. PATENT DOCUMENTS 4,729,451 A * 3/1988 Brander et al. ..... 181/130
4,735,759 A * 4/1988 Bellafiore ..... 264/221
4,878,560 A * 11/1989 Scott ..... 181/130
4,969,534 A * 11/1990 Kolpe et al. ..... 381/328
5,185,802 A * 2/1993 Stanton ..... 381/322
5,357,576 A * 10/1994 Arndt ..... 381/322
5,467,775 A * 11/1995 Callahan et al. ..... 128/715
5,531,954 A * 7/1996 Heide et al. ..... 264/222
5,757,934 A * 5/1998 Yokoi ..... 381/326
5,887,070 A * 3/1999 Iseberg et al. ..... 381/328
6,022,311 A * 2/2000 Juneau et al. ..... 600/25
6,393,130 B1 * 5/2002 Stonikas et al. ..... 381/322

* cited by examiner

*Primary Examiner*—Binh Tieu
*Assistant Examiner*—Suhan Ni
(74) *Attorney, Agent, or Firm*—Welsh & Katz, Ltd.

(57) ABSTRACT

A method of processing an impression of a portion of a user's ear canal that produces a flexible hearing aid housing which duplicates the shape of at least a portion of that impression. A female mold is created using the previously obtained ear impression. A compliant molding material is used to form the female mold. The same material is used to form a male mold in the cavity left in the female mold when the ear impression has been removed. Subsequent to curing of the male mold, it is removed from the female mold and covered with a curable, hardenable plastic such as a UV curable acrylic. Once cured, the compliant male mold is removed leaving a rigid plastic shell whose internal volume conforms in shape to the exterior shape of the ear impression. Mandrels can be inserted into the volume to provide post molding compartments for electronic components. A matrix can be inserted into the internal region or wrapped around the mandrels or respective components. A compliant elastomer can be used to fill, under vacuum, the voids in the rigid shell. When cured, the elastomeric housing can be removed from the rigid shell and the mandrels extracted therefrom. A completed hearing aid can be formed by inserting the respective components into the housing and making the required connections.

28 Claims, 13 Drawing Sheets

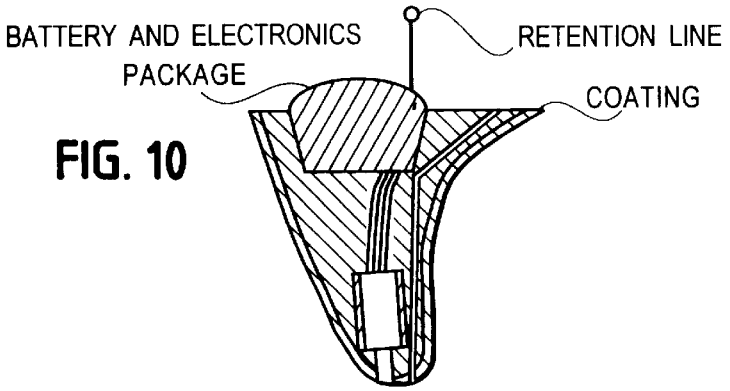
FIG. 10
FIG. 11
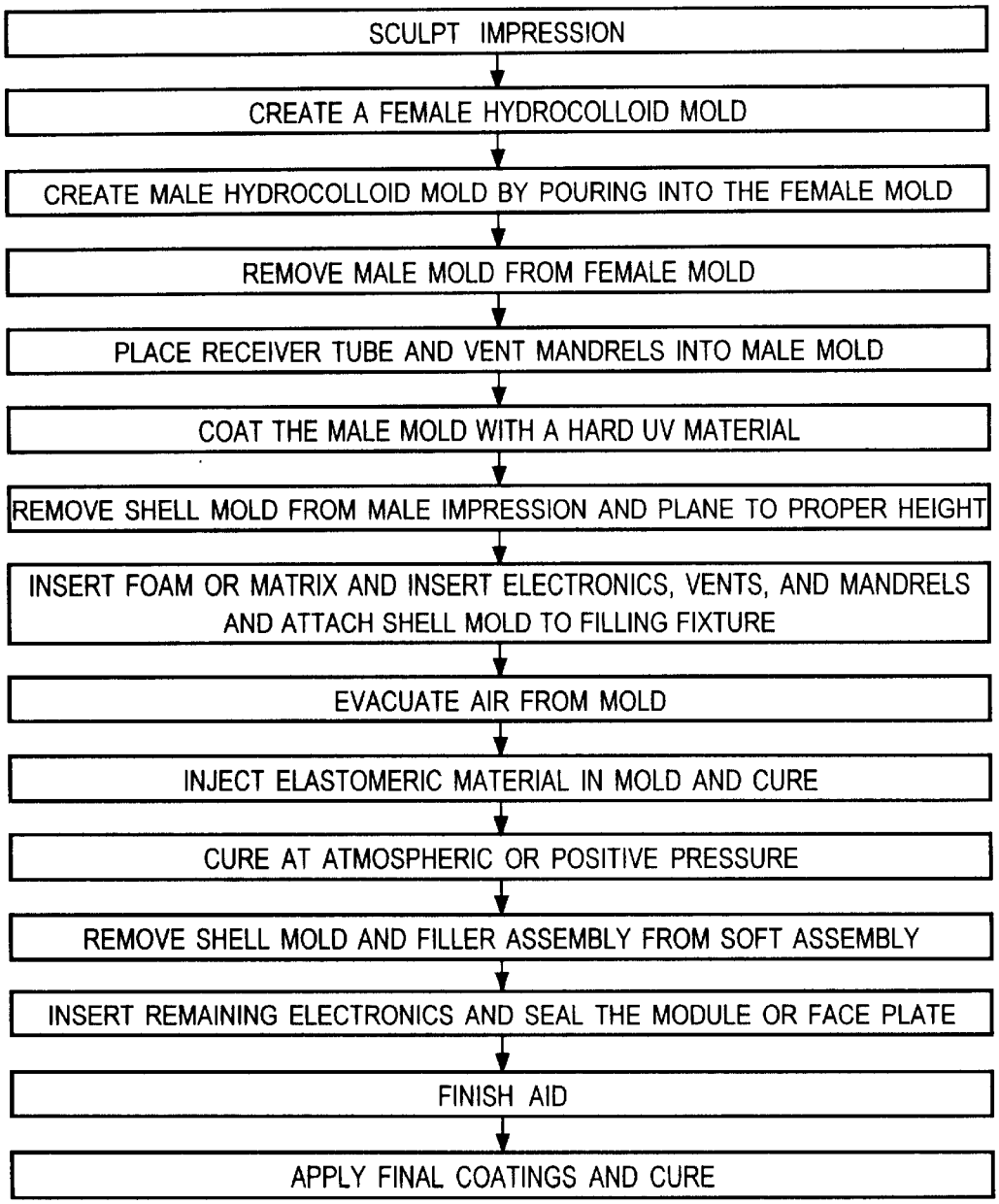

MOLDED HEARING AID HOUSING

The benefit of the filing date of Feb. 2, 1999 of Provisional Application Ser. No. 60/118,261; and Mar. 3, 1999 of Provisional Application Ser. No. 60/122,770 are hereby claimed.

FIELD OF THE INVENTION

The invention pertains to deformable hearing aids. More particularly, the invention pertains to such hearing aids that change shape in response to dynamic changes in the shape of a user's ear canal.

BACKGROUND OF THE INVENTION

It has been recognized that, in certain circumstances, hearing aids can significantly improve the quality of life of individuals that have a hearing deficiency. Contemporary hearing aids are often small enough to fit completely into a user's ear canal. Their small size makes them much more acceptable than older more visible aids.

Despite improvements, there continue to be problems with known hearing aids. Two of these problems are comfort and performance. Contemporary in-the-ear hearing aids usually have an exterior housing molded in accordance with the shape of a user's ear and ear canal. Such housings are often formed of rigid plastic such as an acrylic.

The rigidness often results in a less than comfortable fit when in place and can produce discomfort during the insertion and removal process. In extreme cases, usually resulting from ear surgery, the shape of the user's ear or ear canal has been altered such that a conventional hearing aid could not be inserted.

Up to now, there was no economically feasible way to create a compliant hearing aid that was accurately reproducing the ear impression outer features.

Performance is an issue with rigid hearing aids in that the shape of the ear canal changes while talking or eating. This change in shape can compromise the seal formed between the shell and the ear canal. Integrity of this seal is important in minimizing external feedback around the shell. This in turn limits the user's usable gain and reduces over-all performance of the aid. Maintaining the integrity of this seal makes it possible to operate the aid at higher gain levels, and better compensate for the user's hearing deficiency providing a higher degree of user satisfaction.

Thus, there continues to be a need for hearing aids that are more comfortable to insert and wear than have heretofore been available. There also continues to be a need for improved performance and higher gain, where appropriate, but without performance degrading external feedback.

SUMMARY OF THE INVENTION

A molded, compliant, elastomeric housing for a hearing aid has a shape which is a reproduction of an impression of a portion of a user's ear canal. When inserted, the housing deforms in accordance with the shape of the ear canal so as to permit comfortable insertion. Once inserted, the reproduced region of the housing sealingly abuts the respective portion of the ear canal so as to provide a seal and prevent feedback. Additionally, the housing deforms in response to deformation of the ear canal as the user moves his or her jaw.

In one embodiment, the housing defines an internal region for an output transducer such as a receiver. The receiver can be located in a mold before the molding step occurs. Alternately, a mandrel, which defines a receiver receiving region, can be positioned in the mold.

Irrespective of whether the receiver is molded in place or if a mandrel is used, a matrix is located in the mold for the housing to displace the receiver and associated wiring inwardly from the mold to form a boundary layer. One usable type of matrix is an open cell foam.

When the mold is filled with the compliant housing material, as described below, the material fills the cells of the foam thereby creating an integral, solid boundary layer. This layer insures that the receiver, and associated wiring, are displaced inwardly from the external periphery of the housing by at least the thickness thereof.

Where a mandrel is used, after curing the housing, removal of the mandrel results in a pre-formed, receiver support pocket displaced inwardly from the exterior periphery by the boundary layer. Additionally, there is a cast channel for the wires to the receiver.

In one aspect, the deformability of the housing makes it possible to mold internal component receiving cavities therein with openings which are too small to permit insertion of the components when the housing is in its normal state. However, in response to a deformation force applied to the respective component, the housing deforms thereby enabling the respective component to slide past the obstruction region and into the premolded component receiving cavity. Components can also be removed by deformation. For example, a receiver could be inserted into a deformable housing at either the audio output end or at the exterior open end of the housing.

The matrix can be inserted into the mold and then components or mandrel inserted. Alternately, the matrix can be wrapped around the components or mandrel and the wrapped combination inserted into the mold.

Use of the matrix insures that neither the respective components nor associated wiring will be too close to the exterior peripheral surface of the housing. They can be no closer than the thickness of the matrix.

Where the matrix is an open cell foam, injection of the elastomer into the mold fills the cells and permits flow of the elastomer to the mold surfaces. A solid peripheral surface and a solid interior, except for predefined cavities, result. Thus, a barrier layer composite of compliant elastomer and filled matrix provides, at least for portions of the housing, the required barrier layer.

A sheet member can be incorporated into the housing so as to minimize the possibility of internal feedback when the respective hearing aid is being used.

The compliant material used for the housing can be silicone, latex, polyurethane, polyvinyl or any other type of time, heat or U.V. curable elastomer. The preferred hardness of the selected elastomers is less than 90 ShoreA.

In accordance with a disclosed method to produce a flexible hearing aid housing:

1. An impression is made of the ear canal and a portion of the outer ear of a respective user and coated with a UV curable plastic or wax to remove imperfections;
2. A female mold is cast using a hydrocolloidal-type material, around at least that part of the impression that extends into the user's ear canal. Alternately silicones or other elastomers could be used;
3. The ear impression is removed from the female mold;
4. The cavity in the female mold is filled with the same type of material and cured to form a male mold which is a soft, but exact reproduction of the respective part of the ear impression;
5. The male mold can be removed from the female mold as, due to characteristics of the material, the solid female mold does not bond to the liquid poured in to make the male mold even when the male mold has been cured;

6. A coating of UV curable plastic is formed around the compliant male mold and cured so it hardens;
7. The compliant male mold is then removed from the rigid UV cured coating leaving a rigid female mold with a shape that reproduces the respective portions of the user's ear canal and outer ear;
8. An open cell matrix is inserted into the rigid female mold to create a boundary layer;
9. Mandrels, to define internal regions, or components, such as output transducers, can be positioned in the female mold, or alternatively, the matrix can be wrapped about the mandrels or components prior to insertion;
10. A compliant elastomer is used to fill the female mold encapsulating the mandrels or components and filling the matrix;
11. The housing is then cured by elapsed time, heat, or radiant energy such as UV;
12. The rigid, exterior mold is then removed from the housing and the mandrels are also extracted;
13. Electronic components can then be inserted into the cast regions formed by the mandrels; and
14. A face plate, with battery compartment and electronics can, if appropriate, be attached to the molded housing.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 10 is a side sectional view of a hearing aid having the molded housing illustrated in FIG. 9 subsequent to curing and completion;

FIG. 11 is a flow diagram of the process of FIGS. 1–10;

DETAILED DESCRIPTION OF THE PREFERRED EMBODIMENTS

Figure 1:
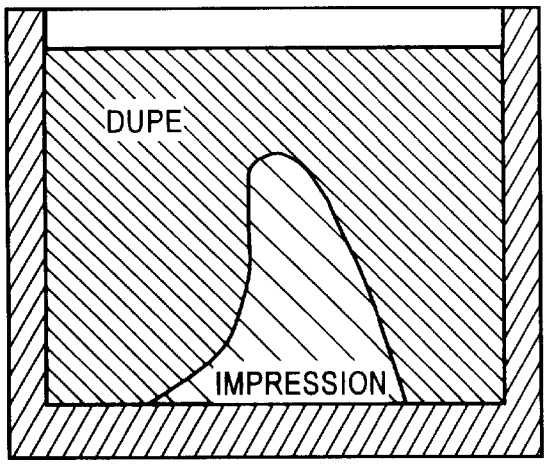
FIG. 1 is a side sectional view of a processing step of forming a female mold of an ear impression.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 2:
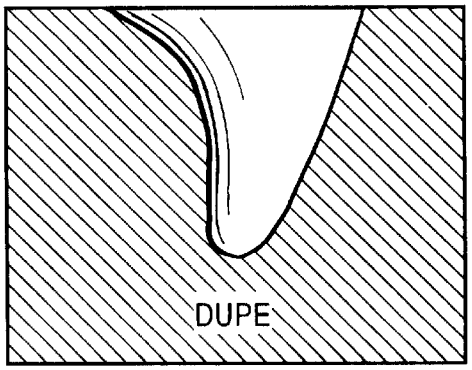
FIG. 2 is a side sectional view of the mold formed in FIG. 1 with the ear impression having been removed.
Figure 3:
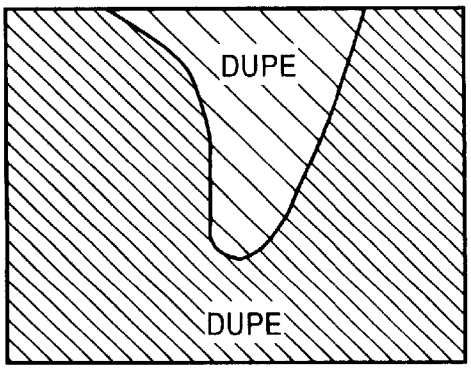
FIG. 3 is a side sectional view of the mold of FIG. 2 with the cavity for the ear impression filled with the same material as used to create the female mold.
Figure 4:
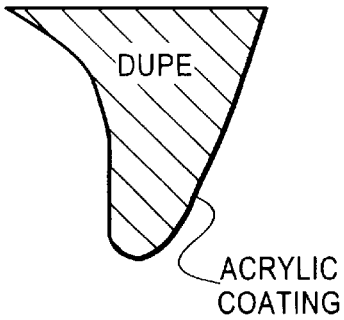
FIG. 4 is a side sectional view of the male mold of FIG. 3 removed from the female mold and coated with a curable plastic coating.
Figure 4A:
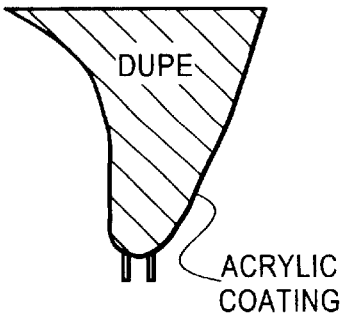
Figure 5:
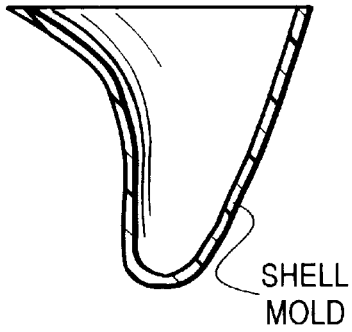
FIG. 5 is a side sectional view of the cured plastic coating of FIG. 4 with the male mold being removed from therein.
Figure 5A:
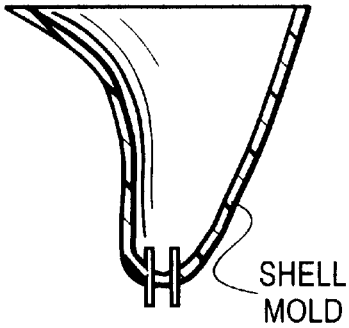
Figure 5B:
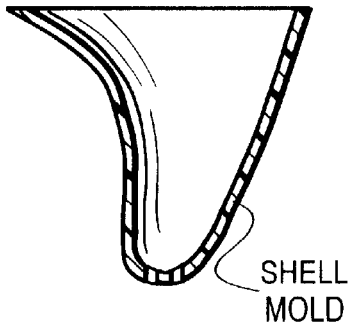

The present methods produce a deformable housing useable in a hearing aid. The housing duplicates the shape of an impression taken of the user's ear canal and outer ear so as to provide comfortable insertion, comfort while in place, and comfortable removal for the user. Advantages of the housing include deformability both while the housing is inserted into the ear canal and while in place so as to maintain a seal with a dynamically changing ear canal, thereby minimizing external feedback. The method includes:

1. Making an ear impression and once the impression has been sculpted, coat it, with a UV curable plastic or wax.
2. Creating a female mold of the impression, FIG. 1, using a compliant hydrocolloidal-type curable material. Cure the mold. Remove the ear impression, see FIG. 2.
3. Creating a male impression by pouring the same type of material into the cured female mold, see FIG. 3.
4. Overcoating the male impression with a layer of UV curable or other hardenable, material and cure, see FIG. 4. Prior to the overcoating step, mandrels for the audio output tube and vent tube can be inserted into the compliant male impression, see FIG. 4A.
5. Separating the male impression from the cured UV coating. This UV coating is the shell-mold, see FIG. 5. Consistent with FIG. 4A where the mandrels had been inserted into the male mold, they extend through the shell-mold, see FIG. 5A.
6. Cleaning the inner surface of the shell-mold.
7. Applying a mold release to the inner surface of the shell-mold and allow it to dry.
8. In the absence of pre-located mandrels or tubes for an acoustic output port and for a vent, create holes in the tip of the shell-mold for the vent tube and receiver sound tube.
9. Attaching a receiver to the receiver sound tube and the receiver wire tube. The later should be sealed with an appropriate compound such as RTV. Insert matrix into shell-mold or wrap components and wires in matrix.

Figure 7:
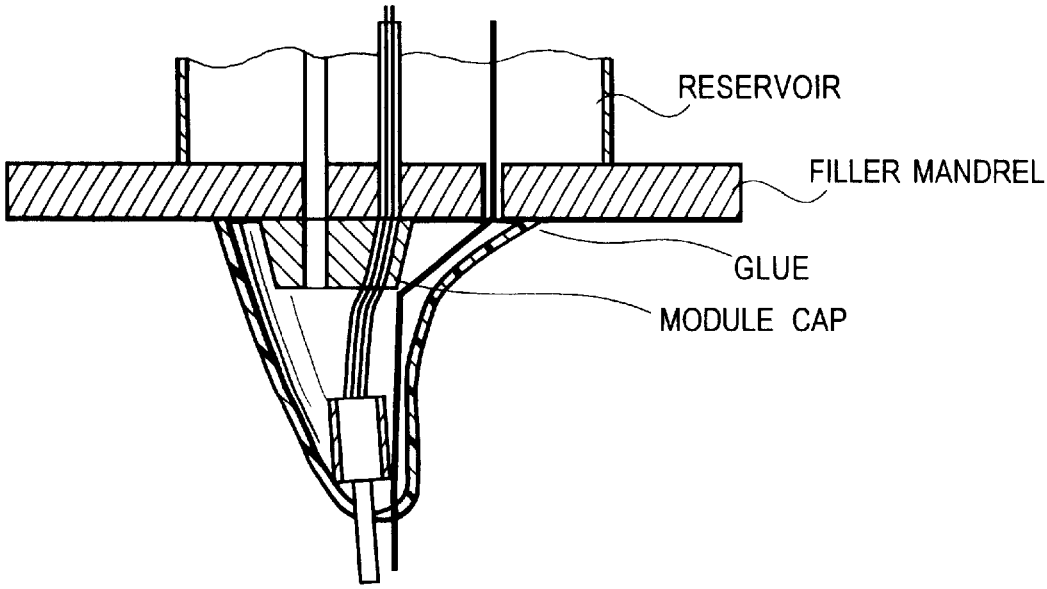
FIG. 7 is a side sectional view of the shell of FIG. 6 attached to a molding fixture.
Figure 8:
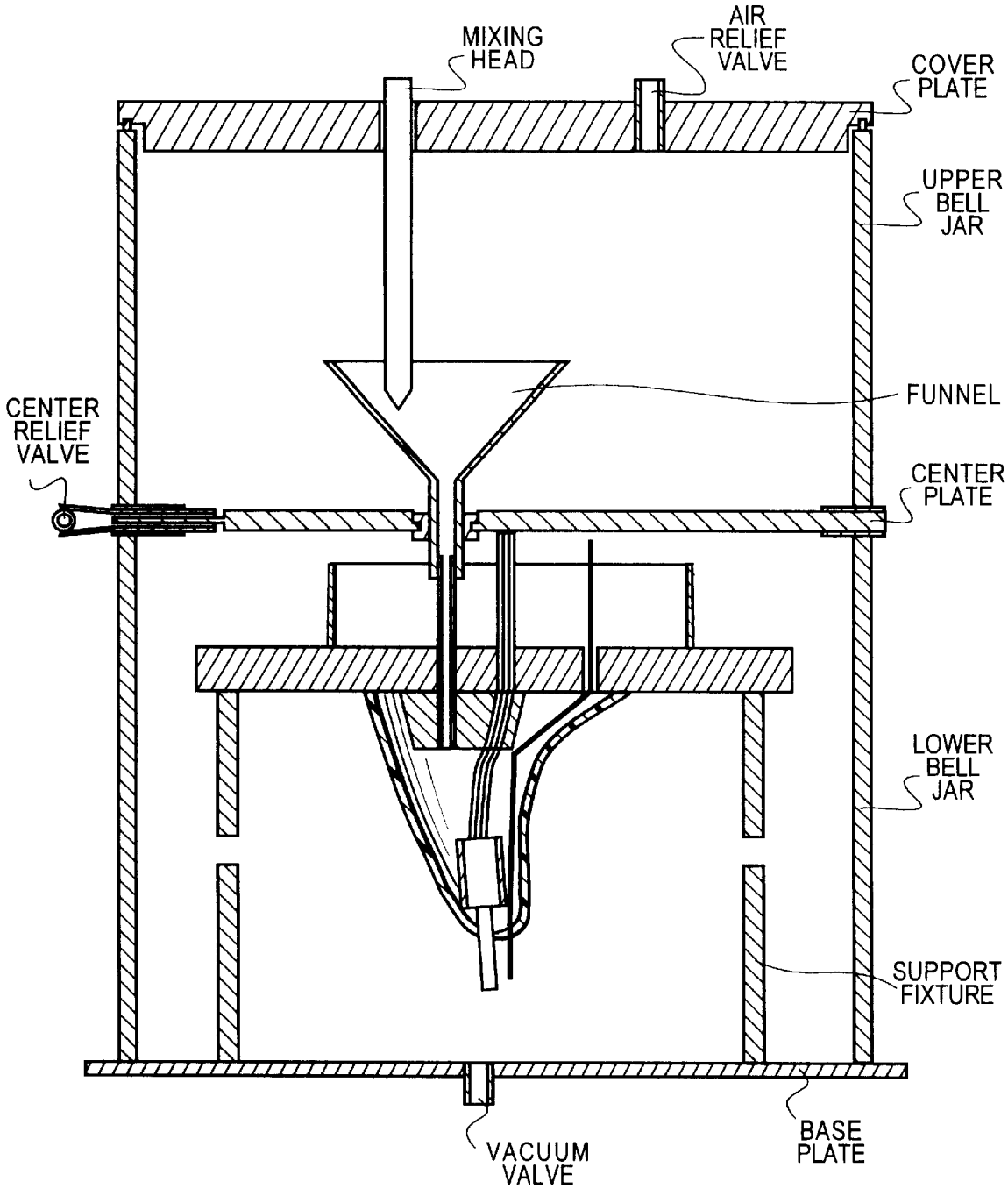
FIG. 8 is a side sectional view of the molding fixture of FIG. 7 positioned in a vacuum-producing unit.
Figure 9:
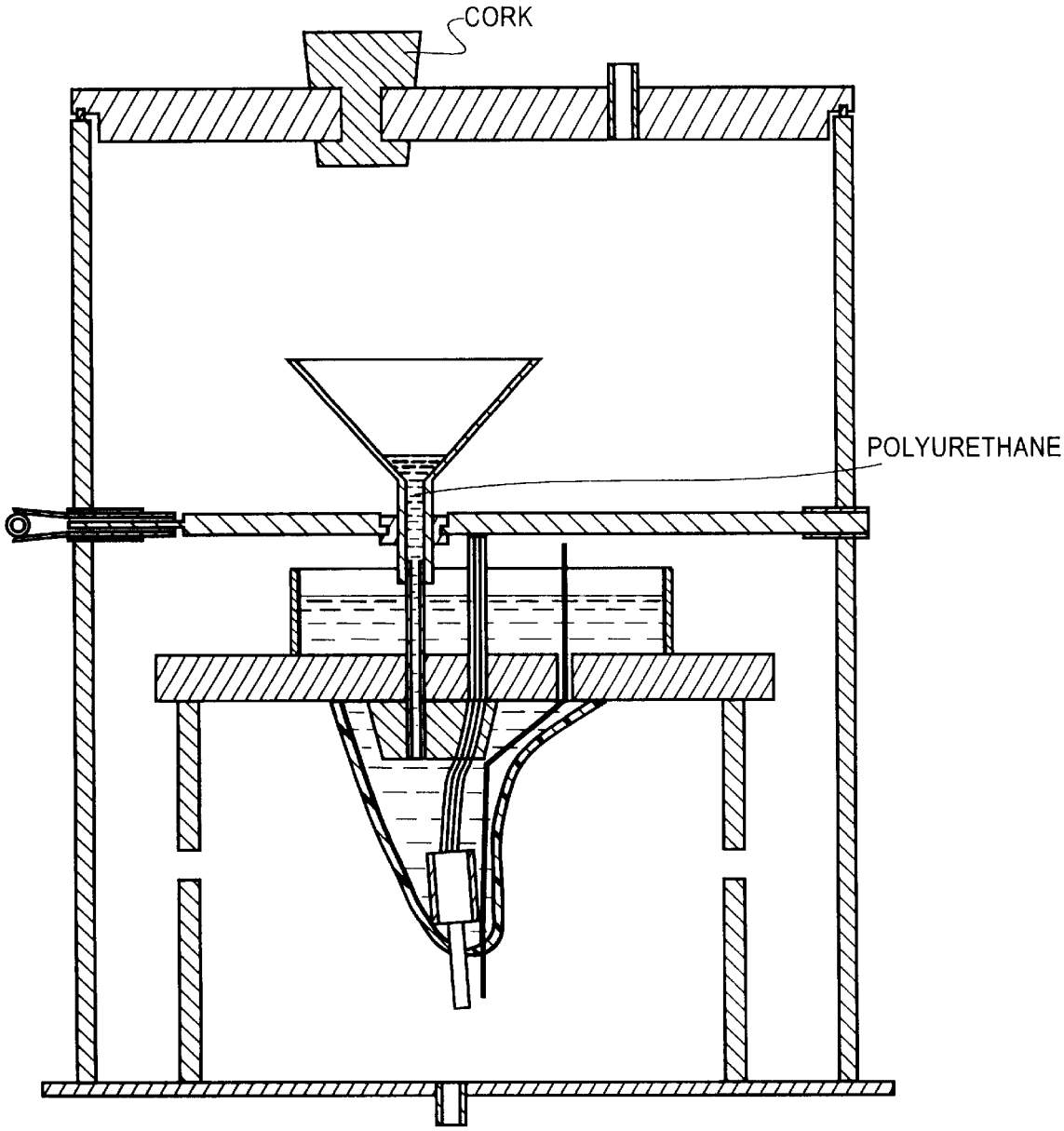
FIG. 9 is a side sectional view of the unit of FIG. 8 with the molding operation having been completed but prior to curing.

10. Place either the vent tube and receiver sound tube into the shell-mold and insert through the appropriate holes or insert appropriate mandrels for a receiver and wires. These parts should be positioned by the matrix so that they are not in contact with the wall of the shell-mold. Seal the tubes with the outer surface of the shell-mold using glue, FIG. 6.
11. Obtain a filler mandrel and the appropriate module cap. Attach the cap to the mandrel and drill a hole in the mandrel for the vent tube, FIG. 7.
12. Place the vent tube through this hole and the receiver wire tube through its hole in the module cap.
13. Glue the shell-mold to the filler mandrel with the proper orientation. The internal parts or components should be oriented so that they are not in contact with the wall of the shell-mold. Alternately a matrix can be used to space components from the wall.
14. Fill the funnel with a selected elastomer, FIG. 8.
15. Evacuate both the upper and lower containers.
16. Induce a differential pressure to force the elastomeric material to flow into the mold, FIG. 9.
17. Cure the elastomeric material.
18. Remove the assembly and break the seal between the filler mandrel and the shell-mold.
19. Detach the shell-mold, the filler mandrel, the module cap, the vent tube, and the receiver wire tube from the housing.
20. Break away the polyurethane material that filled the filler mandrel inlet tube and the reservoir holes. Where a receiver mandrel was inserted into the shell mold, remove the mandrel, deforming the housing as needed and insert a receiver into the molded cavity formed by the mandrel. If need be during insertion, the housing can again be deformed.
21. Connect the receiver wires to an appropriate pre-assembled electronic package.
22. Attach the electronic package to the assembly, FIG. 10. A faceplate could be used to close the housing, instead of a partially covering package as illustrated, if desired.
23. Coat the housing if desired.

FIG. 11 is a flow diagram of the processing described above. It will be understood that other vacuum molding processes could be used without departing from the spirit and scope of the present invention.

Normally, one would not think of wrapping components in a matrix such as an open cell foam because they would become imbedded in the wall. In a vacuum, an open cell foam with the appropriate porosity will fill completely with the fluid elastomeric material before curing and become saturated to the point where it is almost invisible.

The foam can be used to cover the receiver, any other components, the vent tube, and the receiver sound tube. It will act as a spacer from the wall of the shell-mold. Thus, if the component is touching the wall, the foam will become filled with the soft material and prevent the component from penetrating to the shell surface.

The foam can be matched in color to the cured elastomer. The foam in combination with the elastomeric material create a composite material having properties not present in the separate components.

The composite has an altered strength and compressibility. Small pieces of foam can be placed in the mold in addition to covering the components to further increase the strength and compressibility of the material.

The foam can provide additional acoustic benefits to the elastomeric housing by increasing its ability to dampen vibrations. The foam can cover the vent tube for its entire length or only for regions that are likely to touch a wall. The foam can be used to provide greater adhesion between the housing and other components by gluing foam pieces to the component.

It will be understood that other multi-material composites come within the spirit and scope of the present invention. For example, as an alternate to foam, fabric, cork or a mesh can be used.

Figure 12A:
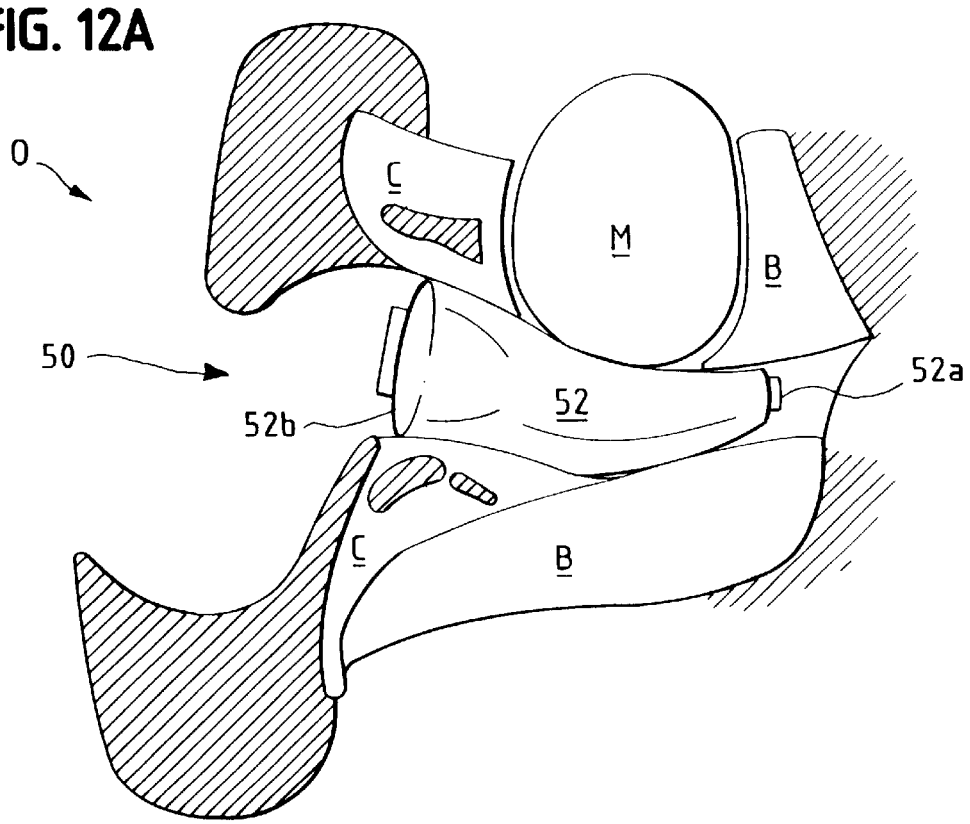
FIG. 12A is an enlarged, partial top view of a user's ear in a quiescent state.

FIG. 12A illustrates a partial top view of the left ear of a user with a hearing aid 50 of the type described above positioned therein. The user's ear includes the outer ear O, an ear canal wherein aid 50 is positioned and tympanic membrane, ear drum, located at the interior end of the canal.

The hearing aid 50 is formed of a soft compliant housing 52 which fills the portion of the ear canal and seals against the adjacent surfaces thereof. Because the housing 52 is soft and deformable, it can comfortably be inserted into and removed from the ear canal. Surrounding the ear canal and the housing 52 are cartilage C. Skull bone B and a portion M of the mandible of the user's jaw.

The mandible M moves relative to the cartilage C and bone B when the user talks, eats or moves his or her jaw for any reason. This in turn alters the shape of the ear canal. FIG. 12A illustrates the canal and housing in a quiescent state when the jaw is at rest. In this circumstance, the shape of the canal corresponds to the shape of an ear impression of the canal such as would be obtained when the user is sitting quietly and not moving his or her jaw. As noted above, housing 52 readily seals against the canal wall in this state.

Figure 12B:
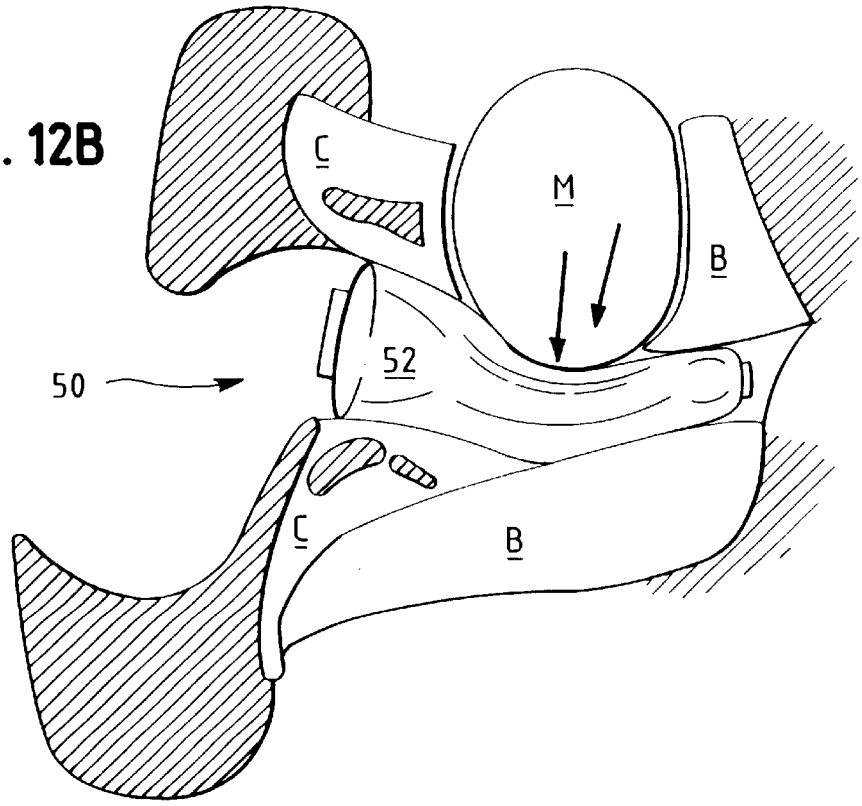
FIG. 12B is an enlarged, partial top view of the ear of FIG. 12A illustrating a changing ear canal.

FIG. 12B illustrates movement of the mandible M as the user moves his or her jaw. The mandible M moves relative to the bone B and housing 52 thereby altering the shape of the ear canal. This alteration in shape has both comfort-related and performance-related consequences. As the mandible moves, the soft compliant housing 52 deforms readily thereby continuing to fit comfortably into the canal as it dynamically changes shape. In addition, because housing 52 continues to conform to the changing shape of the canal, it maintains the seal therewith thereby minimizing external feedback between the audio output port, adjacent to wax guard 52*a* and audio input port 52*b*.

Figure 13A:
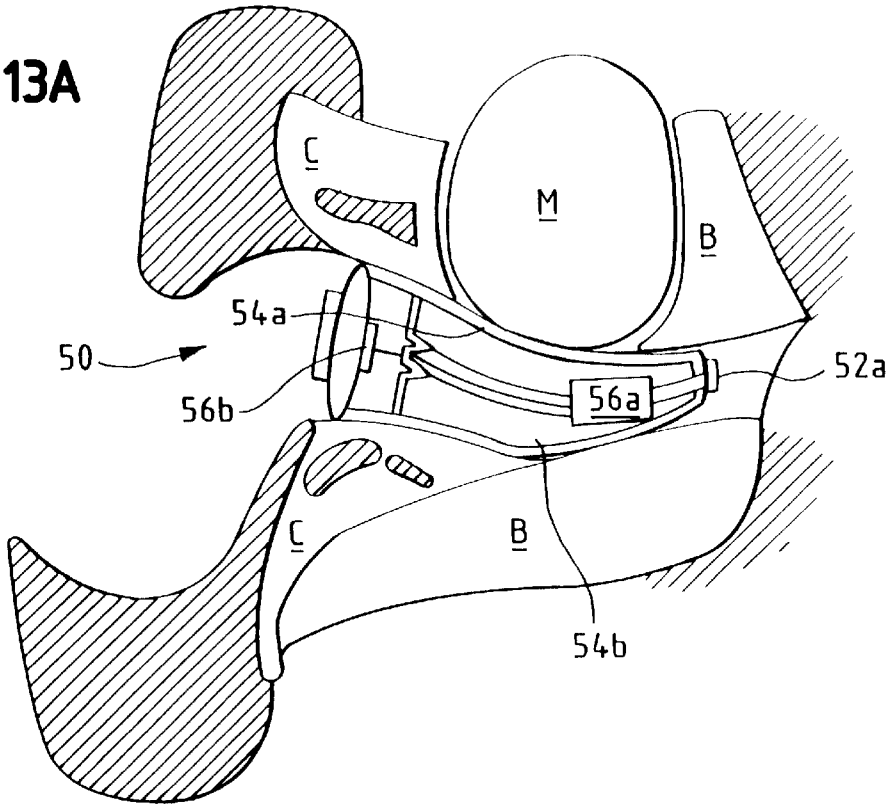
FIG. 13A is a view as in FIG. 12A with the housing of the hearing aid illustrated in section.
Figure 13B:
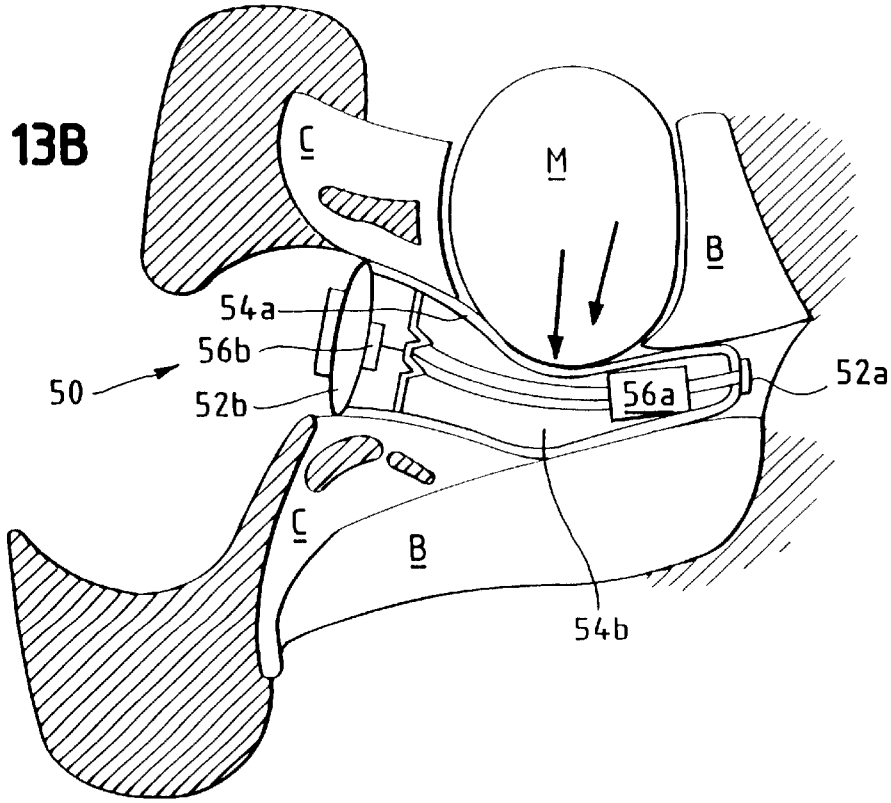
FIG. 13B is a view as in FIG. 12B with the housing of the hearing aid illustrated in section.

FIGS. 13A and 13B illustrate aid 50 in cross section in the canal. The housing 52 is filled, except perhaps for an output transducer 56*a*, a receiver, a battery, and an electronics package 56*b*, with an elastomeric composite as discussed above.

FIG. 13A illustrates the ear and housing 52 in a quiescent state. FIG. 13B illustrates deformation of housing 52 in response to movement of mandible M. Thus, both comfort and performance can be enhanced with hearing aids in accordance with the present invention.

Figure 14A:
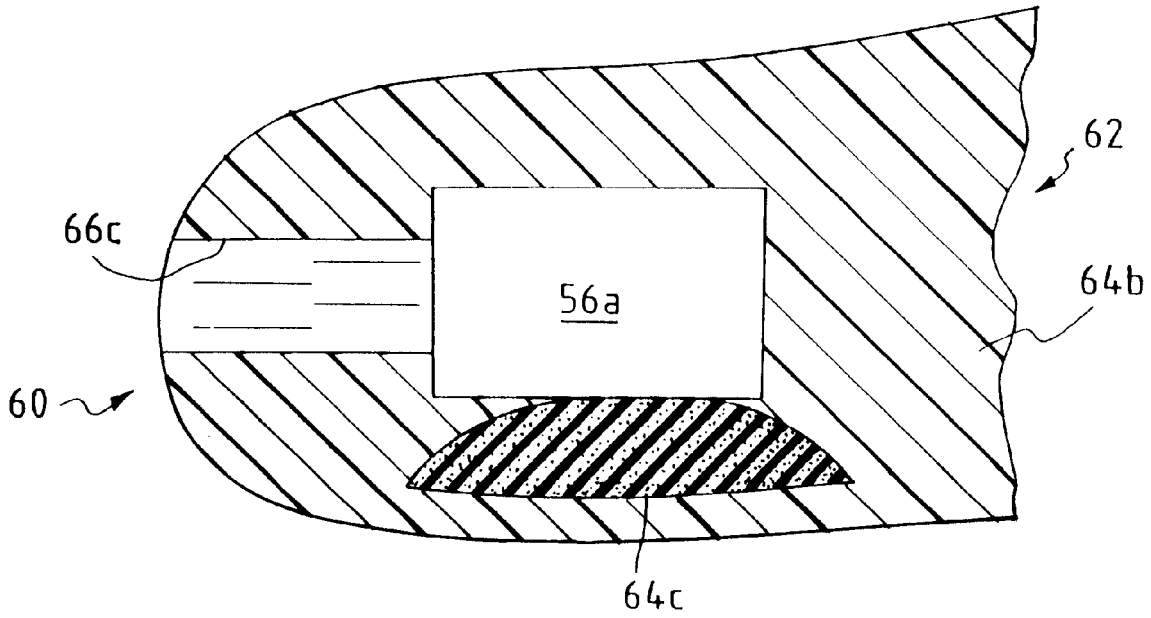
FIGS. 14A, 14B taken together illustrate, enlarged and in section a portion of a hearing aid in accordance herewith.
Figure 14B:
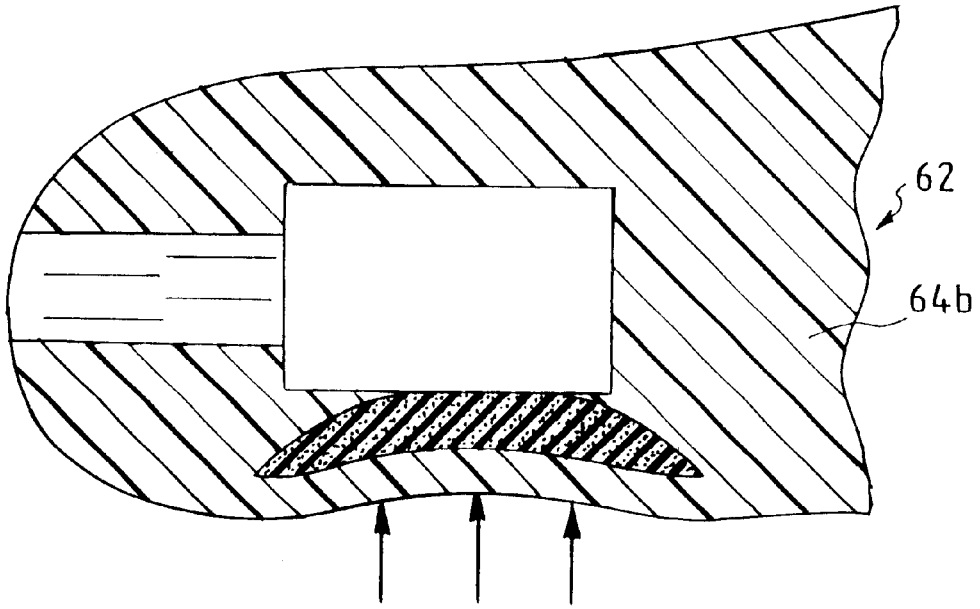

FIGS. 14A and 14B illustrate the benefits of the present invention in dealing with a user's need for a hearing aid 60 to address an anatomical problem in the ear canal. Using the present method, a soft region can be molded into housing 62 to provide a comfortable fit and a seal in a particular user's ear where an especially soft region is necessary in the vicinity of the mandible.

Foam element 64*c* has been molded into the housing 62 in the vicinity of the user's mandible M to provide an extra deformable region which readily deforms in response to mandible M. It will be understood that foam 64*c* is exemplary only. Other types of fluids, such as air, or different elastomers could be used without departing from the spirit and scope of the present invention. In addition, multiple regions could be incorporated into a single housing.

Figure 15A:
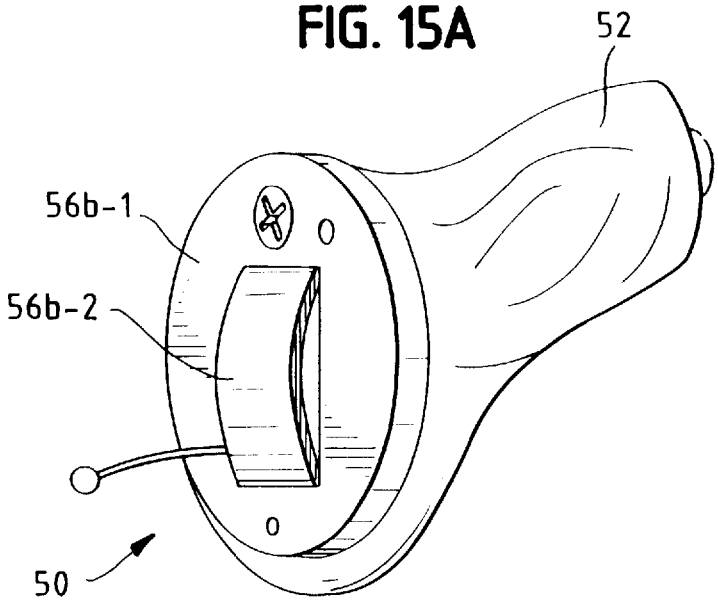
FIG. 15A is an enlarged perspective of a hearing aid in accordance herewith.

FIG. 15A illustrates the hearing aid 50 with a faceplate 56*b*-1 and a battery door 56*b*-2. The faceplate could for example, carry electronic package 56*b* with an associated microphone as an audio input transducer. Faceplate 56*b*-1 is attached to compliant housing 52. When inserted, as described above, the housing 52 deforms to fit the user's ear canal. Faceplate 56*b*-1 is adjacent to the user's outer ear after insertion.

Figure 15B:
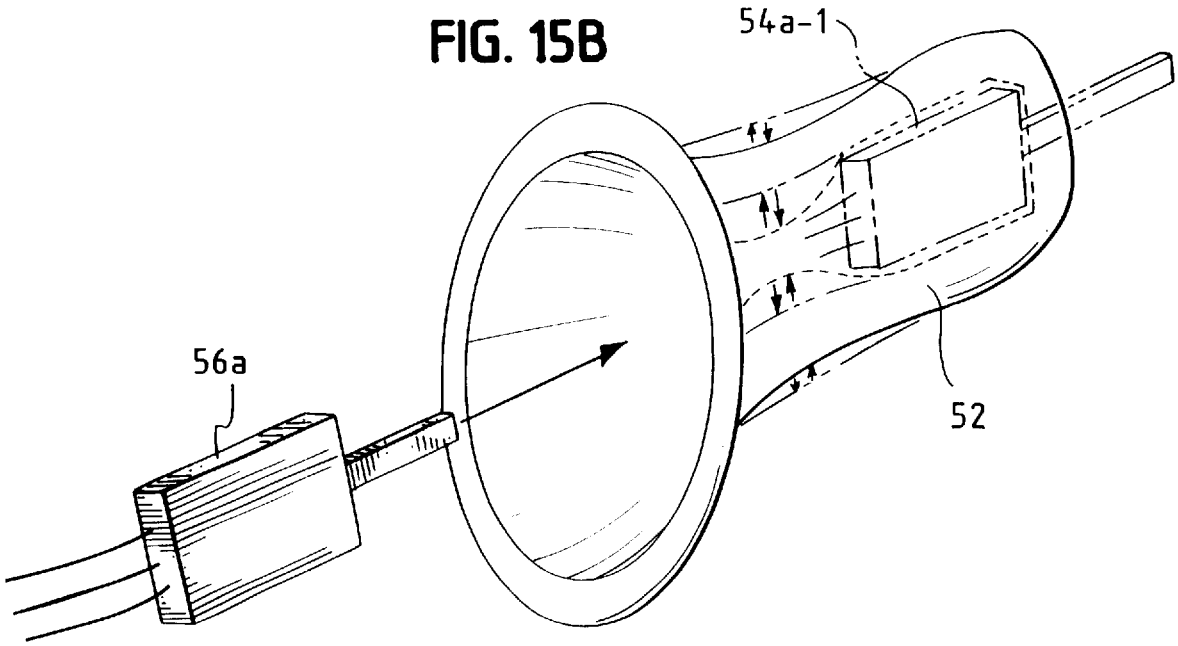
FIG. 15B illustrates deforming a housing in accordance herewith to insert a component therein.

FIG. 15B illustrates another advantage of hearing aid housings in accordance herewith. At times, especially in connection with completely in-the-canal hearing aids, portions of the housing may be too small to easily enable components, such as receivers, to pass into a pre-established region within the housing.

The housing, as noted above, is compliant and deformable. As illustrated in FIG. 15B, a receiver 56*a* can be inserted into a component receiving region 54*a*-1 by inserting the receiver into the housing, temporarily deforming it. When the receiver is located in the region 54*a*-1, the housing returns to its normal, non-distorted shape.

Figure 16A:
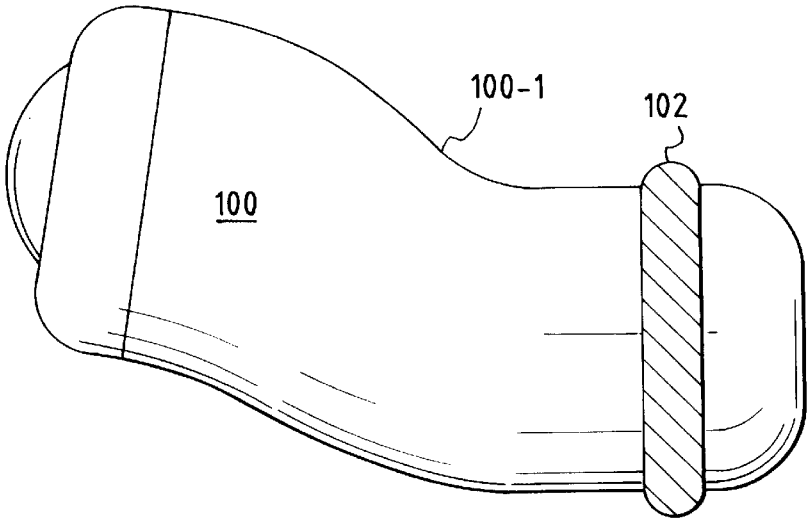
FIGS. 16A, B, C are enlarged side views of an alternate form of the housing in accordance herewith.

FIGS. 16A, B, C illustrate other hearing aids having housings in accordance with the present invention. Each of the illustrated hearing aids 100, 110 and 120 includes a compliant deformable housing respectively indicated at 100-1, 110-1 and 120-1. It will be understood that the respective housings have been created using the above-described process and incorporate the composite material noted above, with the following improvement. Each of the hearing aids 100, 110, 120 carries an enlarged region respectively, cylindrical region 102, elongated enlarged region 112 and three dimensional loop 122. Each of the enlarged regions is integrally molded with the respective housing 100-1, 110-1 and 120-1 and formed at the same time that the housing is formed, out of the same elastomer.

Figure 16B:
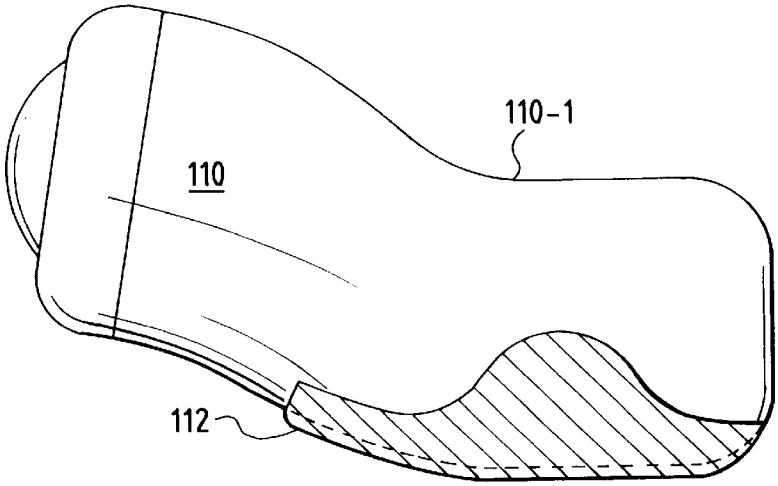
Figure 16C:
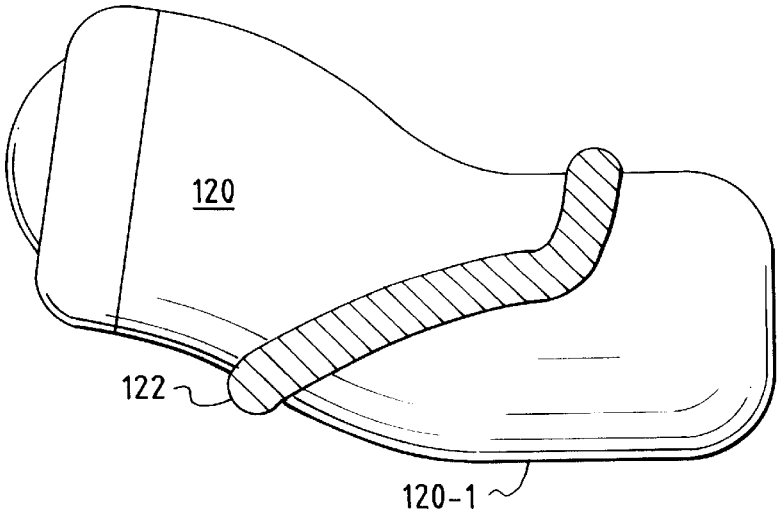

In creating the hearing aids of FIGS. 16A, 16B, 16C, when the impression is made of the user's ear, a determination is made as to where on the respective hearing aid housing it would be desirable to incorporate a protrusion of a selected shape for the purpose of improving the seal between the hearing aid and the ear canal or for improving retention of the hearing, aid in the ear canal.

The characteristics of the protrusions 102, 112 and 122 can be defined by adding to the impression of the user's ear canal, for example, by using wax. The desired protrusion having the exact shape and location to be replicated in the final form of the hearing aid housing. Once the user's ear impression has been modified by adding a ring such as the ring 102 or an enlarged area such as enlarged area 112 or three-dimensional loop such as the loop 122, the above described method steps are used to create a compliant hearing aid using the above-described composite material and incorporating a reproduction or a replica, same size, shape and location, as the protrusion which was added to the original ear impression. While each of the protrusions 102, 112, 122 has been illustrated in the respective figure with cross hatching, it will be understood that this is merely for the purpose of identifying the location, shape and aspect ratio of the protrusion and is not to suggest that the elastomer of which the protrusion is formed is any different from the elastomer of the respective housing. They are the same.

Thus as described above, integrally molded elastomeric seals can be added to hearing aid housings formed in accordance herewith to take into account particular characteristics of the user's ear canal or to improve the seal between the housing and the ear canal as the ear canal dynamically changes shape in response to movement of the user's jaw.

Figure 17A:
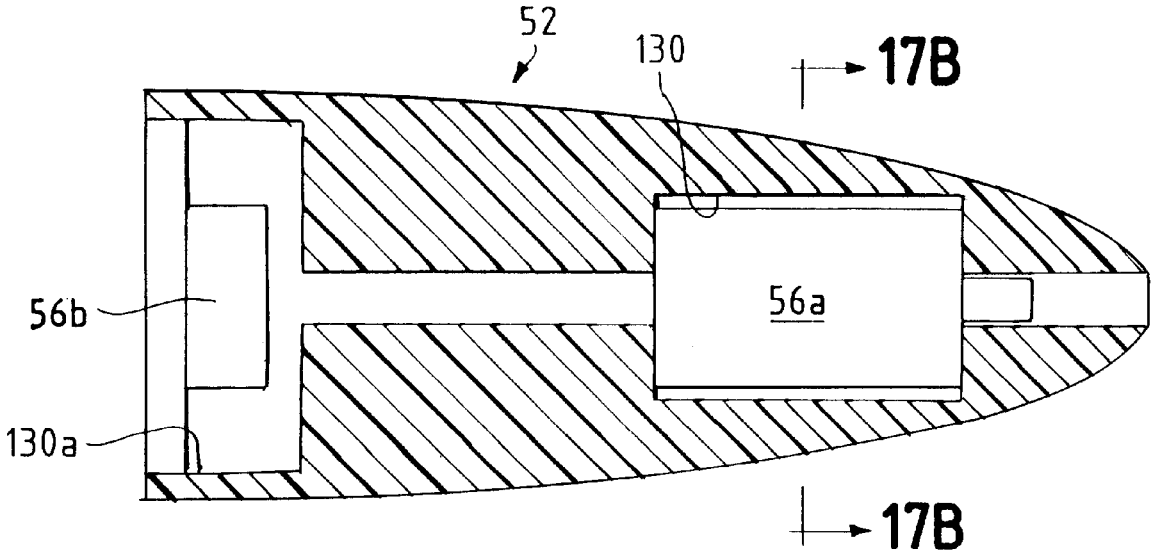
FIGS. 17A, B are alternate sectional views illustrating spaced apart supports for a receiver.
Figure 17B:
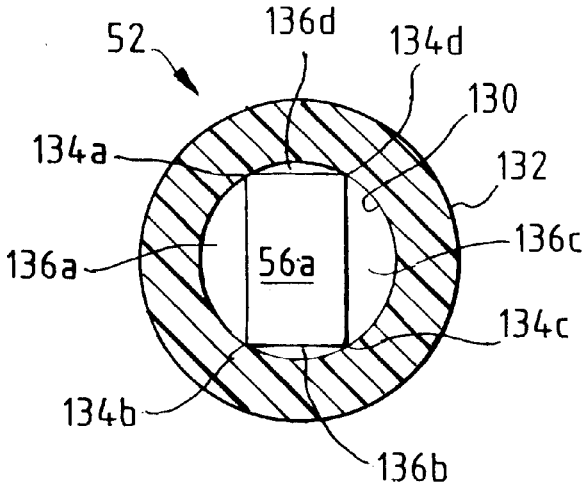

FIGS. 17A and B illustrates yet another advantage of a hearing aid formed in accordance herewith. FIG. 17B is a sectional view of the housing 52, characteristics of which were discussed above, taken in the vicinity of the receiver 56*a*. In the particular example of FIGS. 17A, B, a mandrel was used to define the shape of a receiver compartment 130. As discussed above, the receiver compartment 130 could be bounded by composite material formed of an elastomer and a matrix so as to displace the compartment 130 inwardly from an exterior peripheral surface 132 of housing 52. A second mandrel was used to define an electronics package/battery compartment 130*a*.

The size of the precast compartment 130 can be selected so as to support receiver 56*a* at only a plurality of spaced-apart locations 134*a*, 134*b*, 134*c* and 134*d*. In between support regions, such as 134*a*, 134*b*, the gaps or spaces 136*a*, 136*b*, 136*c* and 136*d* isolate the remainder of the receiver 56*a* from the housing 52. The gaps or spaces 136*a* . . . *d* could be filled with a fluid such as air or other sound absorbing foams or material without limitation.

The use of isolated support for receiver 56*a* makes it possible to minimize internal feedback in the housing 52 which results from coupling between the receiver 56*a* and the microphone of the hearing aid.

A further advantage results from the present invention in that the receiver 56*a* can be oriented in the chamber 130 so as to be out of phase with the microphone 52*b* located at the other end of the hearing aid on, for example, a faceplate. Preferably the receiver 56*a* and the microphone 52*b* could be oriented on the order of 90° out of phase with one another so as to minimize coupling therebetween.

Figure 6:
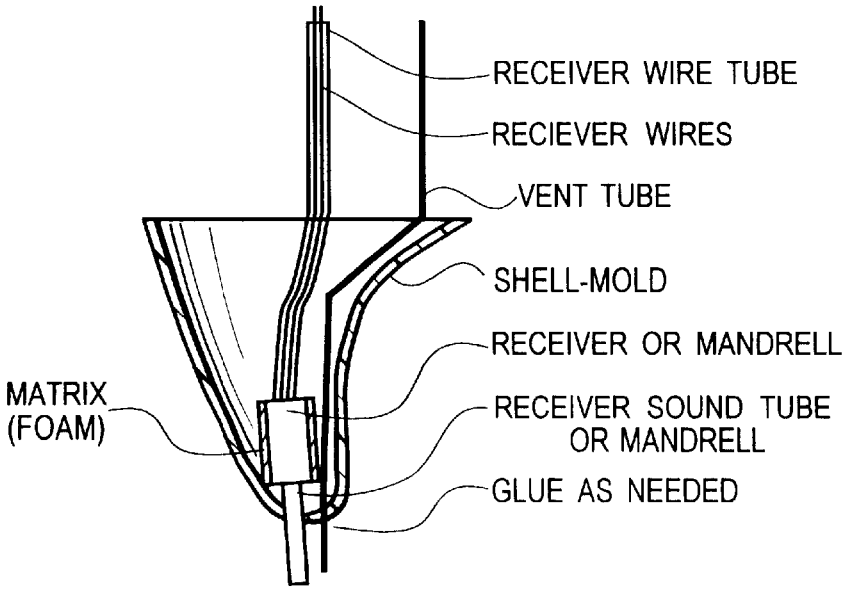
FIG. 6 is a side sectional view of a rigid shell with a receiver or mandrel for same and a vent tube or mandrel for same, located in the shell.
Figure 18A:
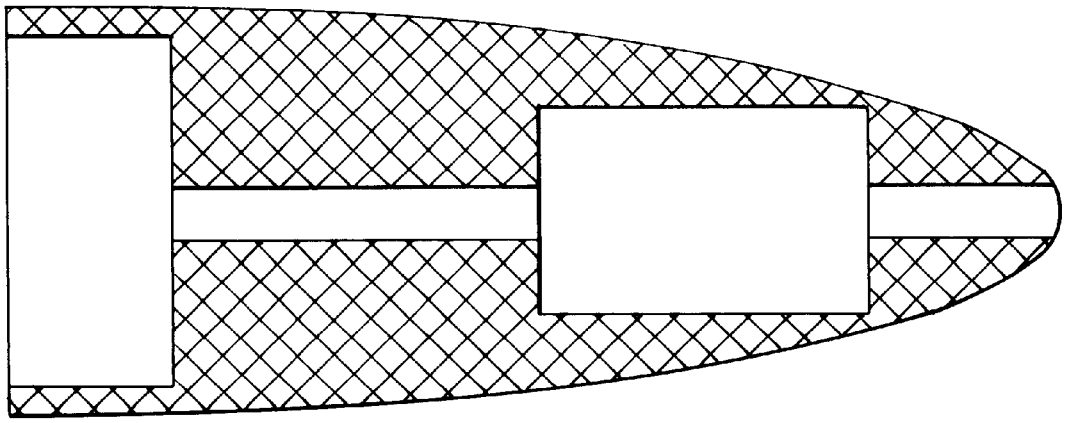
FIG. 18A is an enlarged side sectional view of an unimpregnated matrix in a mold.
Figure 18B:
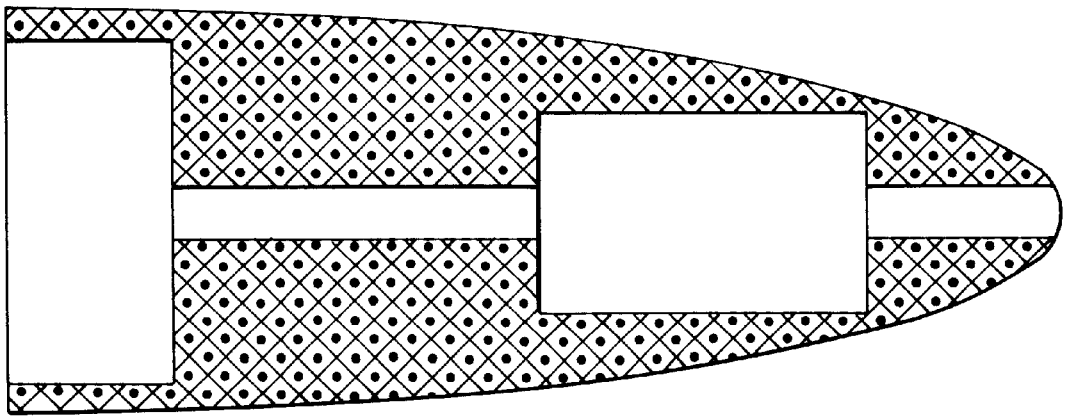
FIG. 18B is an enlarged side sectional view of a composite housing after the molding process.

FIG. 18A illustrates an unimpregnated matrix in a mold, such as the shell mold of FIG. 6. FIG. 18B illustrates a composite housing, such as housing 52 after the molding process, FIGS. 8, 9 has been completed. The cured elastomer, represented by dots, has filled the cells in the matrix to form a composite.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A hearing aid comprising:

a housing molded of a compliant elastomer, wherein the housing has an exterior periphery and the housing defines at least one internally formed, component carrying region, wherein the housing includes an integrally formed peripheral boundary layer which displaces the region inwardly of the housing away from the exterior periphery and wherein the depth of the boundary layer is determined, at least in part, by a matrix, the matrix comprising a porous structure, the porous structure permeated by the elastomer.

2. A hearing aid as in claim 1 wherein the matrix comprises an en cell foam material.

3. A hearing aid as in claim 1 which includes at least an output transducer, molded into the housing wherein the transducer is displaced inwardly of the periphery at least by a portion of the elastomer permeated matrix.

4. A hearing aid as in claim 1 which includes an output transducer, inserted in a preformed region in the housing wherein that region is bounded, at least in part, by the matrix.

5. A hearing aid as in claim 4 which carries an input transducer with a first orientation and wherein the output transducer has an orientation selected so as to minimize feedback.

6. A hearing aid as in claim 4 wherein the output transducer is supported only at selected spaced apart locations by the housing.

7. A hearing aid as in claim 6 which includes spaces between the output transducer and the preformed region.

8. A hearing aid as in claim 7 wherein at least some of the spaces are filled with a gas.

9. A hearing aid as in claim 1 wherein the component carrying region is defined by a mandrel removable from the housing, at least in part by deforming a portion of the elastomer.

10. A hearing aid as in claim 9 which includes a receiver output tube wherein the location and orientation of the tube were established using a deformable representation of the housing.

11. A hearing aid as in claim 5 wherein the transducers are oriented so as to be on the order of ninety degrees out of phase with one another.

12. A hearing aid as in claim 1 wherein the housing conformably seals a portion of a user's ear canal thereby minimizing external feedback.

13. A hearing aid as in claim 12 wherein the housing conforms, in response to dynamic deformation of the user's ear canal, thereby maintaining the seal.

14. A hearing aid as in claim 1 having a selected surface, covered only in part by an electronic module wherein the module is displaced from direct contact with the user's ear.

15. A hearing aid as in claim 1 wherein a selected surface of the housing is covered by a rigid face plate.

16. A hearing aid as in claim 15 which includes a battery compartment carried on the faceplate.

17. A hearing aid as in claim 15 wherein the housing carries an output transducer wherein the output transducer is displaced, at least in part, from the exterior periphery by the boundary layer.

18. A hearing aid as in claim 17 which carries an input transducer adjacent to the faceplate wherein the transducers are oriented so as to be out of phase with one another.

19. A hearing aid as in claim 18 which includes speech processing circuitry, comprising at least a gain element, coupled between the transducers.

20. A hearing aid as in claim 1 wherein a selected component can be inserted into or removed from the housing by deforming same.

21. A hearing aid comprising:

a housing molded of a compliant elastomer, wherein the housing has a deformable exterior periphery and the housing defines at least one internally formed, component carrying region, wherein the housing includes an integrally formed, deformable, peripheral boundary layer which displaces the region inwardly of the housing away from the exterior periphery and wherein the depth of the boundary layer is determined, at least in part, by a matrix, the matrix comprising a porous structure, the porous structure permeated by the elastomer.

22. A hearing aid as in claim 21 wherein the matrix comprises one of an open cell foam and a fabric.

23. A hearing aid as in claim 21 which includes at least an output transducer, carried in the housing wherein the transducer is displaced inwardly of the periphery at least by a portion of the elastomer permeated matrix.

24. A hearing aid as in claim 23 which carries an input transducer with a first orientation and wherein the output transducer has an orientation selected so as to minimize feedback.

25. A hearing aid as in claim 23 wherein the output transducer is supported only at selected spaced apart locations by the housing.

26. A hearing aid as in claim 25 which includes spaces between the output transducer and the housing.

27. A hearing aid as in claim 26 wherein at least some of the spaces are filled with a gas.

28. A hearing aid as in claim 26 wherein the transducers are oriented so as to be on the order of ninety degrees out of phase with one another.

* * * * *